US006633141B1

(12) United States Patent
Dijkman

(10) Patent No.: US 6,633,141 B1
(45) Date of Patent: Oct. 14, 2003

(54) DISPLAY DEVICE WITH DEFLECTION MEANS AND MEANS FOR INFLUENCING THE DISTANCE BETWEEN ELECTRON BEAMS

(75) Inventor: Willibrordus Jurrianus Dijkman, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/716,911

(22) Filed: Nov. 20, 2000

(30) Foreign Application Priority Data

Nov. 23, 1999 (EP) ..... 99203924

(51) Int. Cl.[7] ..... H01J 29/51

(52) U.S. Cl. ..... 315/368.25; 315/368.26; 315/368.28; 313/402; 313/403

(58) Field of Search ..... 315/368.25, 368.26, 315/368.28, 382.1, 368.11, 1, 3, 399; 313/402, 403, 408, 409

(56) References Cited

U.S. PATENT DOCUMENTS 4,864,195 A * 9/1989 Masterton ..... 315/371
5,027,042 A * 6/1991 Sluyterman et al. ..... 313/412
5,118,999 A * 6/1992 Jackson et al. ..... 315/382
5,248,920 A * 9/1993 Gioia et al. ..... 315/368.26

FOREIGN PATENT DOCUMENTS

WO WO9934392 7/1999 ..... H01J/29/70

* cited by examiner

*Primary Examiner*—Don Wong
*Assistant Examiner*—Thuy Vinh Tran

(57) ABSTRACT

A cathode ray tube display having an in-line tube includes an electromagnetic unit for dynamically influencing the path or shape of the electron beams. The power for supplying current to the electromagnetic unit is drawn from the line deflection circuit, either through supply coil on a transformer arranged in parallel with the line deflection coil, or from a supply coil sound around the deflection unit core.

17 Claims, 7 Drawing Sheets

Figure 1:
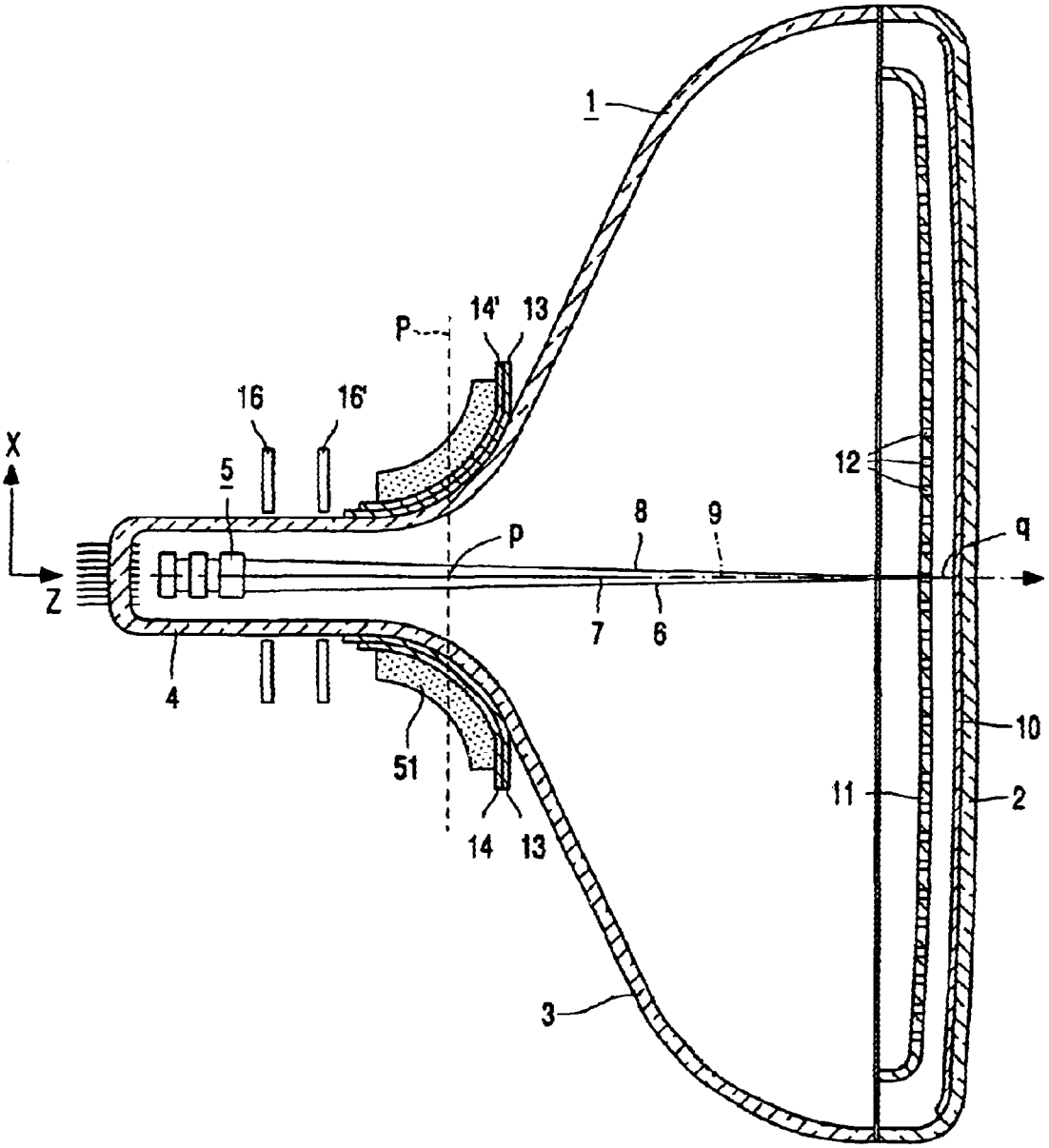
FIG. 1 PRIOR ART

DISPLAY DEVICE WITH DEFLECTION MEANS AND MEANS FOR INFLUENCING THE DISTANCE BETWEEN ELECTRON BEAMS

BACKGROUND OF THE INVENTION

1. Field of the Invention

The invention relates to a display device comprising a cathode ray tube comprising an in-line electron gun for generating at least one electron beam, a phosphor screen on an inner surface of a display window, a deflection means for deflecting the electron beams and an electromagnetic means for generating a magnetic field to dynamically influence the path or shape of the electron beams as a finction of a position where the electron beam lits the phosphor screen, and means for supplying a current to the electromagnetic means.

2. Description of the Relate Art

Such a device is known from PCT-application no. WO99/34392-A1. The known device comprises a color display device comprising a deflection unit for deflecting the electron beams across a color selection electrode. The known device also comprises a pair of means, which are arranged at some distance from each other so as to dynamically influence the trajectories (paths) of the electron beams and to decrease the distance between the electron beams at the location of the deflection plane as a function of the deflection. By doing so, the distance between the electron beams decreases for larger deflection angles. The distance between the color selection electrode and the phosphor screen is inversely dependent on the distance between the electron beams. Thus, a decrease of the distance between the electron beams enables the distance between the color selection electrode and the phosphor screen to be increased.

WO99/34392-A1 discloses a design in which the electromagnetic means are arranged in series with the deflection coils. Such direct driving has the disadvantage that the co-operating means draw their power directly from the deflection circuit and are coupled directly to the deflection circuit. The currents through the co-operating means will be temperature-dependent, i.e. as the temperature of the co-operating means increases, the current through the co-operating means is influenced, which influences the deflection current. Conversely, a temperature increase of the deflection coils influences the deflection current, thereby influencing the current through the co-operating means. Furthermore, the current through the co-operating means cannot be more than the current through the deflection circuit, putting a limit on the available current through the co-operating means. If the current through the co-operating means is to be smaller than the deflection current, a part of the deflection current will have to bypass the co-operating means, leading to a loss of power.

BRIEF SUMMARY OF THE INVENTION

It is an object of the invention to provide a display device as described in the opening paragraph, having an improved power supply for the electromagnetic means.

To this end, a display device according to the invention is characterized in that the means for supplying a current comprise a transformer arranged in parallel with the line deflection coil, or the means for supplying a current comprise a supply coil wound around the deflection core.

In a device in accordance with the invention, the energy for driving the electromagnetic means is drawn from the deflection circuit. Thus, the supply means can be and preferably is provided on the deflection unit. This removes the need for an external supply means and simplifies the design of the device. In a device in accordance with the invention, the power for driving the electromagnetic means is taken from the deflection circuit without, however, substantially influencing the deflection, as will be explained below.

Preferably, the supply means are arranged in such a way that the power is drawn from the fly-back voltage of the horizontal deflection coil.

In this embodiment, negative effects on the deflection are reduced with respect to embodiments in which the power is drawn from the scan voltage.

These and other objects of the invention are apparent from and will be elucidated with reference to the embodiments described hereinafter.

BREIF DESCRIPTION OF THE SEVERAL VIEWS OF THE DRAWING(S)

Figure 2A:
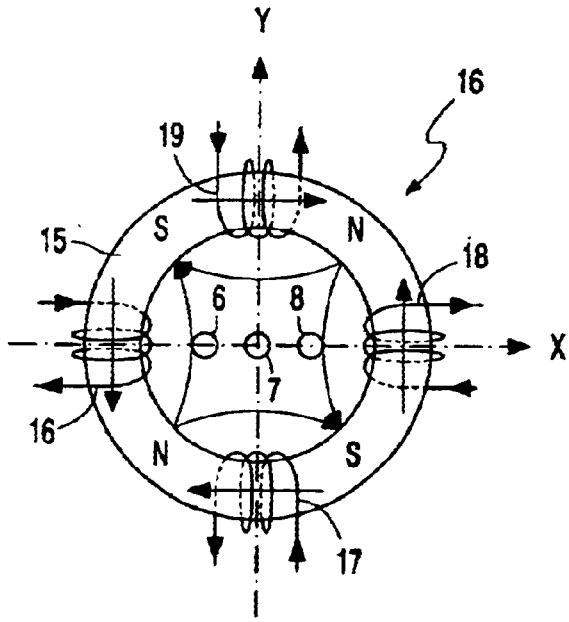
FIG. 2A PRIOR ART
Figure 2B:
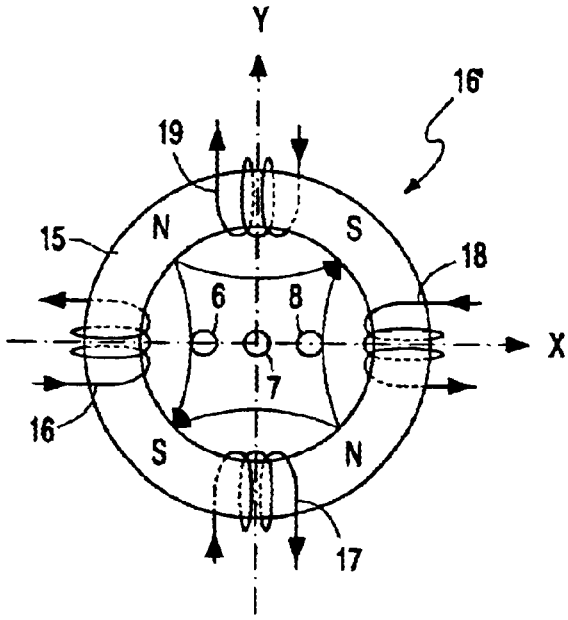
FIG. 2B PRIOR ART
Figure 3:
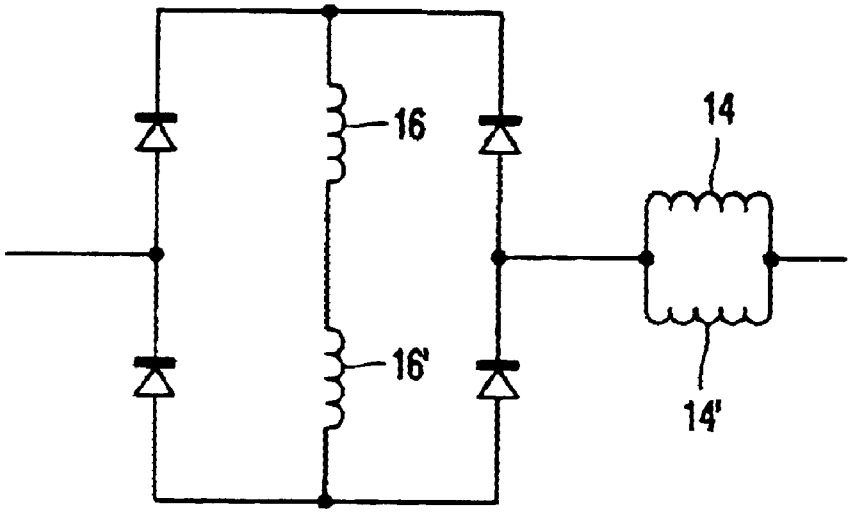
FIG. 3 PRIOR ART
Figure 8:
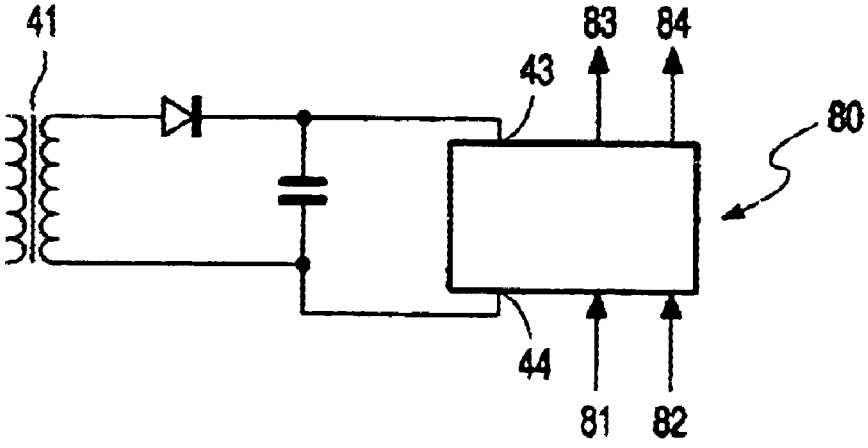
Figure 4A:
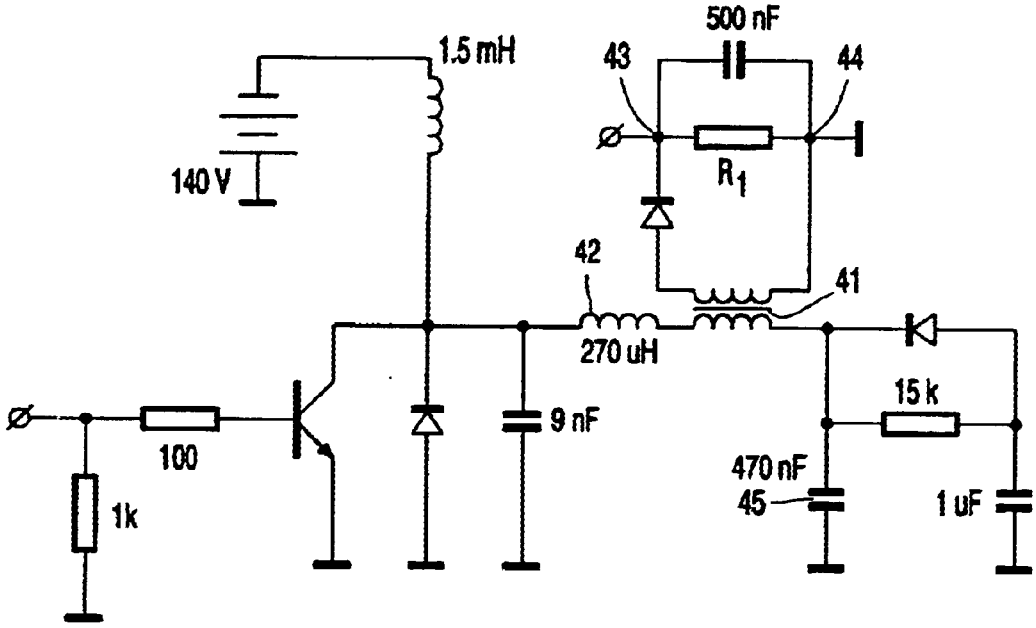
Figure 4B:
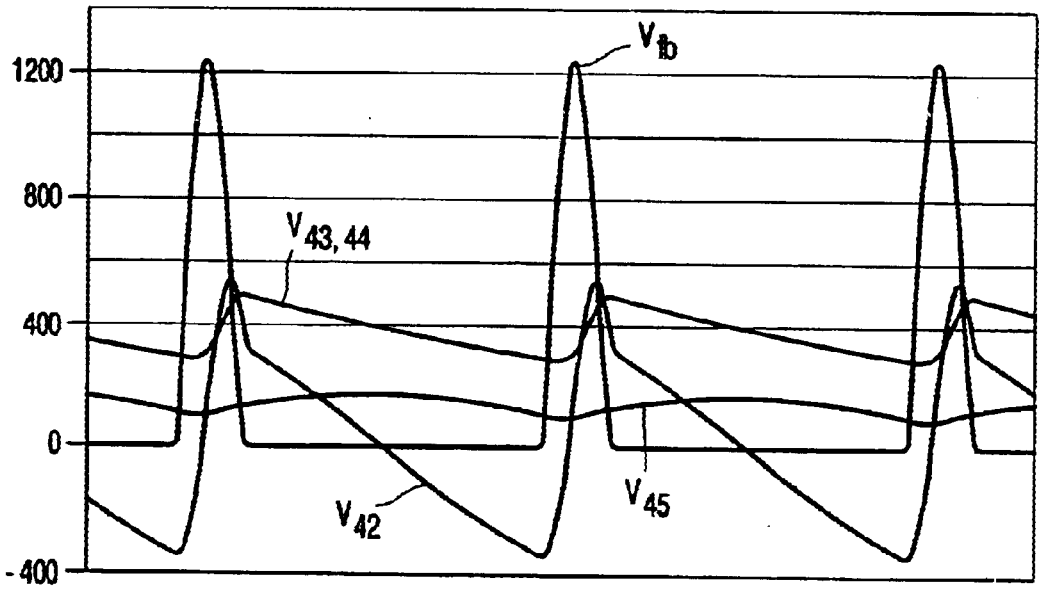
Figure 5A:
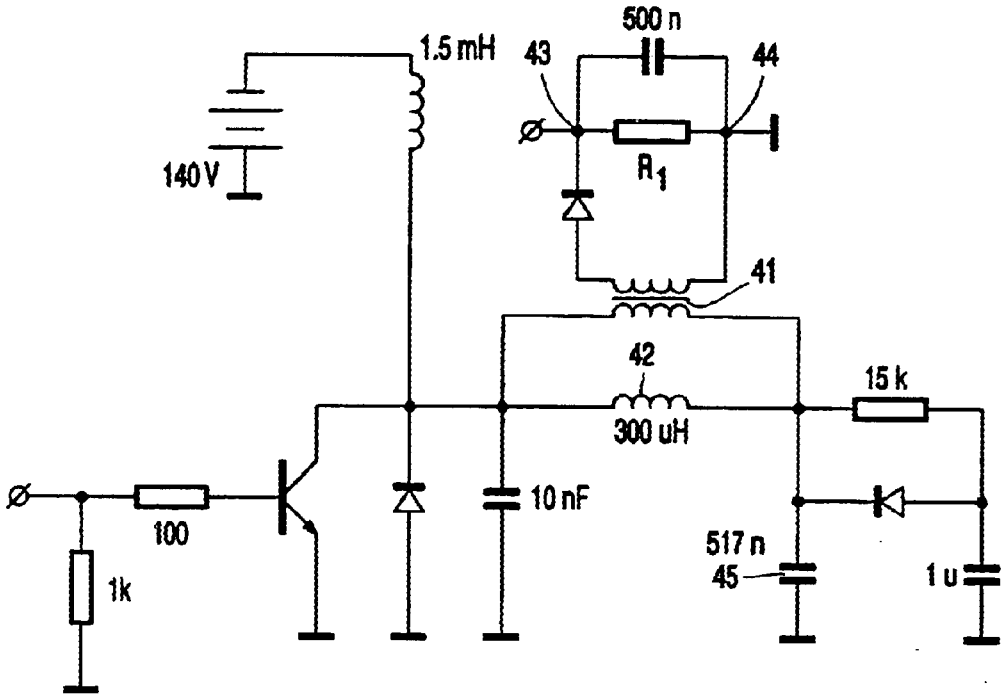
Figure 5B:
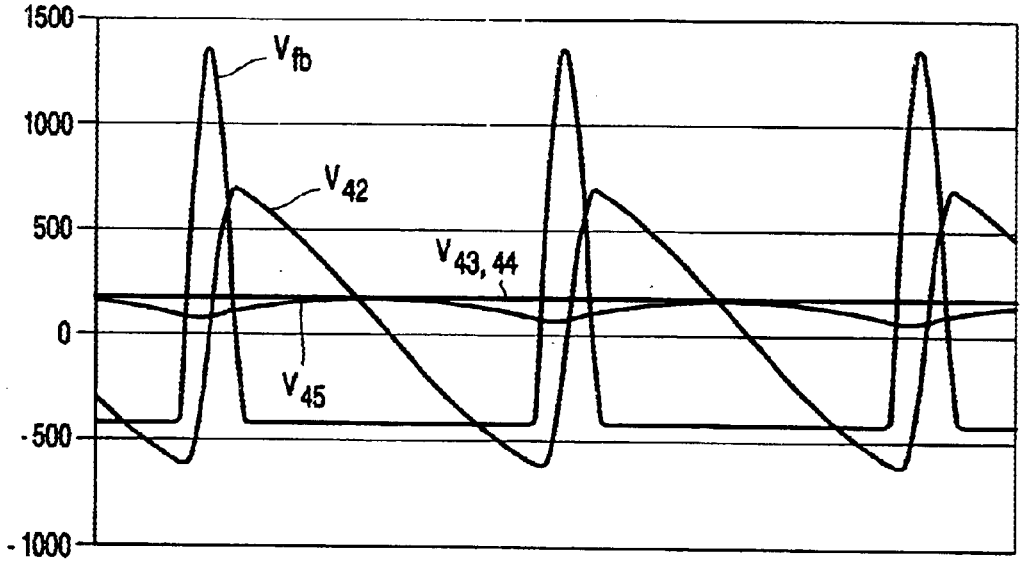
Figure 6A:
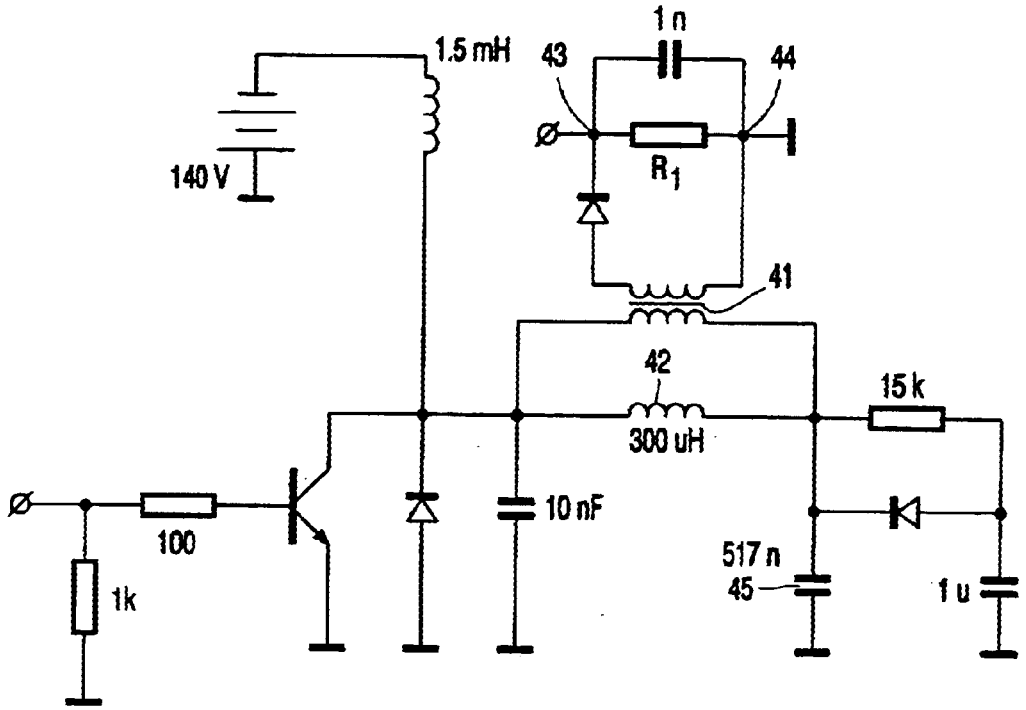
Figure 6B:
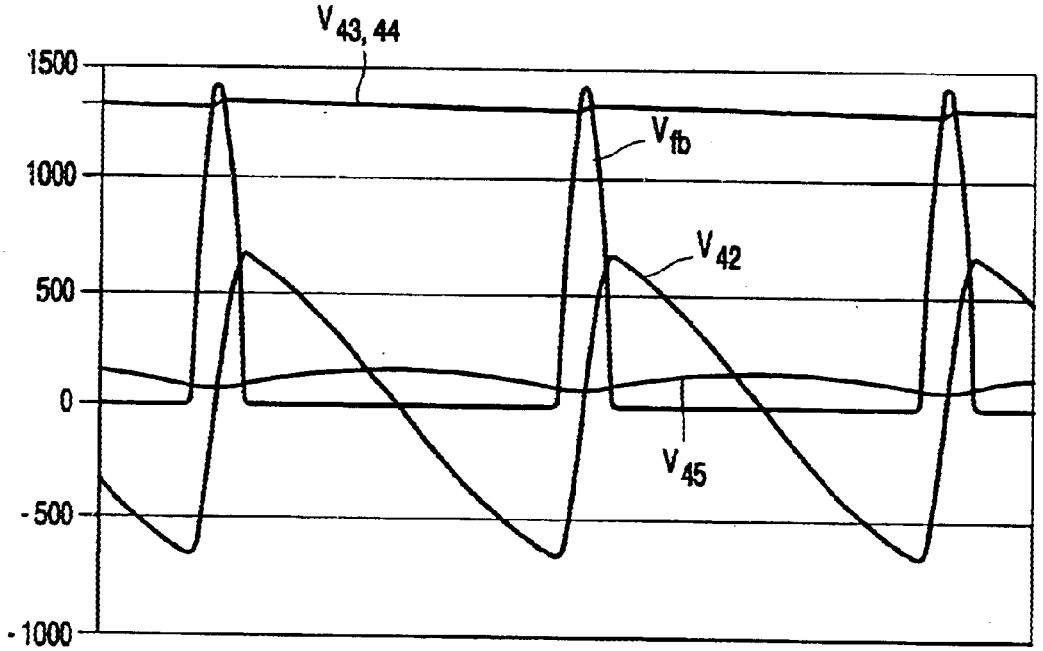
Figure 6C:
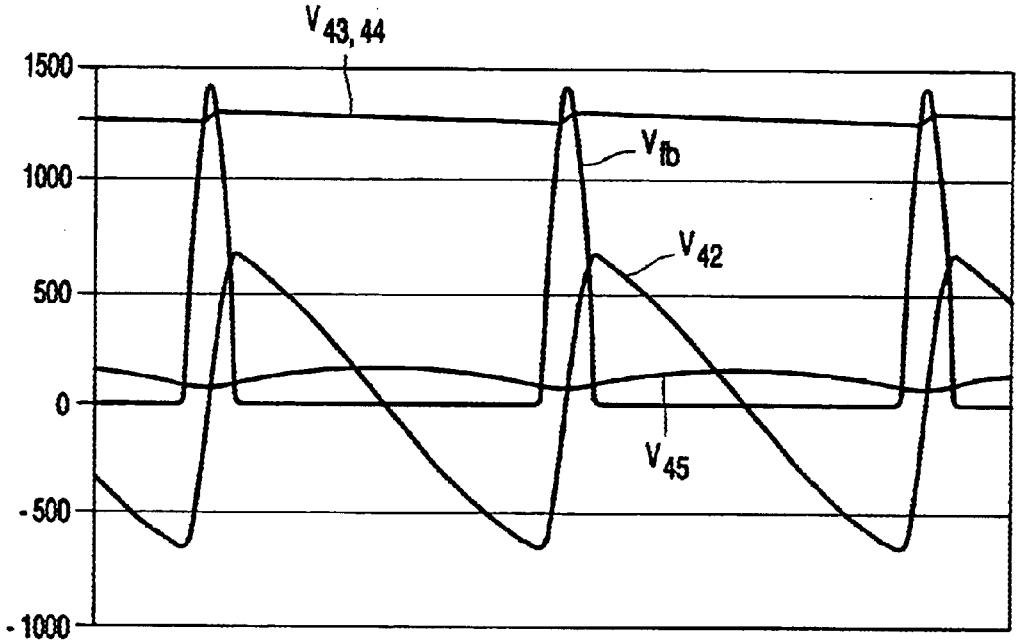
Figure 7:
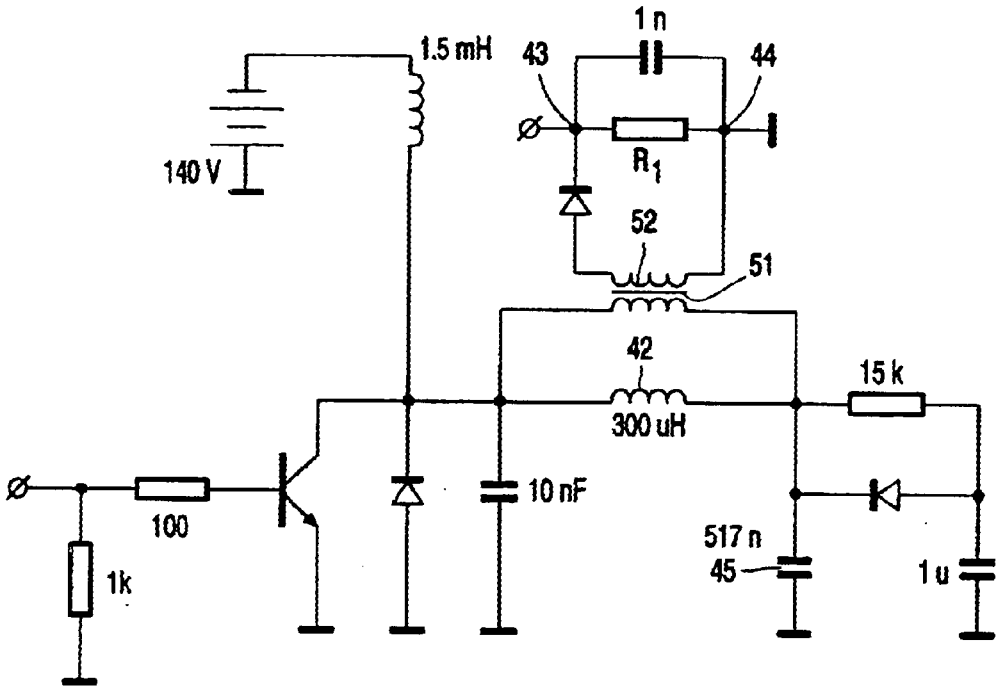

In the drawings:

FIG. 1 is a sectional view of a display device according to the prior art, with which the invention may be used, FIGS. 2A and 2B show schematically a number of quadrupole elements, FIG. 3 shows a known arrangement, FIGS. 4A and 4B show schematically a circuit for a device in accordance with the invention and the resulting voltages, FIGS. 5A and 5B show schematically a circuit for a preferred device in accordance with the invention and the resulting voltages, FIGS. 6A to 6C show schematically a circuit for a device in which the transformer is placed in series with the horizontal deflection coil, FIG. 7 shows schematically a circuit for a device in which a supply coil is wound around the deflection core, FIG. 8 shows in more detail how the electromagnetic means for influencing the path or shape of the electron beams is fed.

The Figures are not drawn to scale. In the Figures, like reference numerals generally refer to like parts.

DETAILED DESCRIPTION OF THE INVENTION

FIG. 1 shows a color display device comprising a color cathode ray tube, having an evacuated envelope 1, which includes a display window 2, a cone portion 3, and a neck 4.

The neck 4 accommodates an electron gun 5 for generating three electron beams 6, 7 and 8 which extend in one plane, the in-line plane, which in this example is in the plane of the drawing. The invention may be used for display devices in which only one electron beam is generated, but the advantages are most-prominent for color display tubes of the in-line type. In the undeflected state, the central electron beam 7 substantially coincides with the tube axis 9. The inner surface 10 comprises a large number of phosphor elements luminescing in red, green and blue. On their way to the display screen, the electron beams are deflected across the display screen 10 by means of an electromagnetic deflection unit 51 and pass through a color selection electrode 11 which is arranged in front of the display window 2 and comprises a thin plate having apertures 12. The three electron beams 6, 7 and 8 pass through the apertures 12 of the color selection electrode at a small angle relative to each other and hence each electron beam impinges only on phosphor elements of one color. In addition to a coil holder, the deflection unit 51 comprises coils 14, 14' and 15, 15' for deflecting the electron beams in two mutually perpendicular directions. The display device further includes means for generating voltages which, during operation, are fed to components of the electron gun via feedthroughs. The deflection plane P is schematically indicated, as well as the distance p between the outer electron beams 6 and 8 in this plane, and the distance q between the color selection electrode and the display screen.

The color display device comprises two co-operating means 16 and 16', a first means being used, in operation, to dynamically bend, i.e. as a finction of the deflection in a direction, the outermost electron beams more towards each other as a finction of deflection, and a second means 16' serving to dynamically bend the outermost beams in opposite directions as a finction of deflection. FIGS. 2A and 2B show examples of such means. In this case, means 16 (FIG. 2A) comprises a ring core of magnetizable material on which four coils 17, 18, 19 and 20 are wound in such a manner that, upon excitation, a 45° quadrupole field is generated. A 45° quadrupole field can be alternatively generated by means of two wound C-cores or by means of a stator construction. The construction of 16' (FIG. 2B) is comparable to that of means 16. However, the coils are wound in such a manner, and the direction in which, in operation, current passes through the coils is such that a 45° quadrupole field is generated, having an orientation which is opposite to that of the 45° quadrupole field shown in FIG. 2A.

The three electron beams are separated from each other in the plane of deflection P (a plane in which the z-position is situated approximately in the centre of the deflection unit 11) by a distance p (see FIG. 1). The distance q between the color selection electrode 12 and the display screen 10 is inversely proportional to the distance p.

The means 16 are to be supplied with a current. The inventors have found that, if the co-operating means are driven in parallel, the effects of errors in driving currents add up, whereas the effects of errors in driving current (at least in a first order approximation) cancel each other if the co-operating means are driven in series. Furthermore, driving in a series arrangement as compared with driving in parallel reduces the power dissipated in the driving means. FIG. 3 shows schematically an arrangement for supplying a current to the means, 16, 16' as known from FIG. 5 of WO99/34392-A1. The current through the coils 14, 14' is rectified and sent through the means 16, 16'. The means 16, 16' are thus directly coupled to the coils 14, 14' and draw power directly from the current through the deflection coils 14, 14'. This has a number of shortcomings as described above. The current through the co-operating means cannot be, more than the current through the coils 14, 14'. If the current has to be smaller, part of the deflection current must bypass the co-operating means 16, 16', leading to a loss of power. In operation, the coils 14, 14' and the means 16, 16' are subject to substantial temperature changes which may have a negative influence on the function of both coils 14, 14' (and thus on the deflection of the electron beams) of co-operating means 16, 16'.

Therefore deriving the power for the quadrupoles (in this example, there are two quadrupoles, but in simpler examples there may be one) directly from the deflection current poses problems.

Providing a separate driving unit with its own power supply for driving the quadrupoles is a possibility but requires an external circuit to be provided by the set maker, which complicates the design.

Doing away with an external power supply simplifies the design.

In the device in accordance with the invention, the power for the electromagnetic means (which in embodiments may be means generating a dipole(s) instead of a quadrupole(s)) is drawn from a deflection current.

The inventors have found that the vertical deflection current has a relatively low frequency. This means that power transfer requires large transformers and decoupling capacitors. Furthermore, the vertical deflection circuit handles little power. This means that drawing the power for the electromagnetic means may have large consequences for the driving circuits.

In a device in accordance with the invention, the power is drawn from the horizontal deflection current. The horizontal deflection has a higher frequency and the driving circuit handles more power.

Putting a transformer in series with the horizontal deflection coil was found to strongly distort the horizontal sawtooth signal (i.e. the horizontal deflection current). This would result in image errors. It was also found that the sensitivity was negatively influenced.

FIGS. 4A and 4B show schematically a circuit in which a transformer 41 is arranged in series with a horizontal deflection coil 42. The transformer and a circuit provide a voltage between the points 43 and 44. The load representing the quadrupoles is schematically indicated by a resistance R1 of 1K. Also indicated is a so-called s-shaping capacitor 45.

FIG. 4B shows the scanning voltage $V_{42}$, the rectified driving voltage $V_{43\text{-}44}$, and the voltage across capacitor $V_{45}$. The rectified voltage $V_{43\text{-}44}$ shows large excursions and the scanning voltage shows large irregularities. Thus, it can be concluded that the deflection is negatively influenced. FIG. 4B also shows the fly-back voltage $V_{fb}$.

FIGS. 5A and 5B illustrate schematically a circuit for a device in accordance with the invention. The transformer 41 is arranged parallel across the horizontal deflection coil(s) 42. The design of the circuit having the supply points 43, 44 is chosen to be such that $V_{43\text{-}44}$ is basically the rectified voltage $V_{45}$ In such a design, the power for the electromagnetic means (schematically indicated in FIG. 5A by R1) is drawn from the scanning voltage. The resulting voltage $V_{43\text{-}44}$ is much more stable (see FIG. 5B) than the corresponding voltages of FIG. 4B and the scanning voltages ($V_{42}$ and $V_{45}$) show much fewer irregularities. Thus, the power required for driving the electromagnetic means is drawn from the horizontal deflection, using a transformer parallel across the horizontal deflection coil. Although the result is satisfactory, there still remain problems on closer inspection. The sawtooth voltage $V_{42}$ experiences a DC shift which is dependent on the load of the transformer. This is an unwanted effect.

FIGS. 6A, 6B and 6C show a preferred embodiment of the invention. Similarly as in FIG. 5A, the transformer 41 is arranged parallel across the horizontal coil 42. However, the design is chosen to be such that the power is drawn from the flyback voltage $V_{fb}$. The resulting voltages are shown in FIG. 6B (for a load of 5W) and in FIG. 6C (for a load of 10W). Compared to the design of FIGS. 5A and 5B, there are a number of advantages: The voltage $V_{43\text{-}44}$ is higher, thus enabling higher voltages to be used, and the sawtooth voltage $V_{42}$ does not suffer from a DC shift. Therefore, this is a preferred embodiment.

FIG. 7 illustrates schematically a circuit for a device in accordance with the invention in which the means for supplying a current comprises a supply coil 52 which is wound on the deflection core 51. This design is comparable to the design shown in FIG. 6A but has the advantage that fewer elements are needed.

In all circuit schemes, the load $R_1$ comparable to the load due to the means 16, 16' is schematically indicated by $R_1$.

FIG. 8 shows more details of the part of the means for supplying a current schematically indicated by $R_1$. The voltage across points 43–44 is fed to a circuit 80. Said circuit

80 comprises inputs 81, 82 through which signals indicating the vertical and/or horizontal position of the electron beams (for instance, signals indicative of the horizontal and/or vertical deflection current are applied to circuit 80). Driving currents 83 and 84 (which could be one and the same) are available at outputs 83 and 84 (this could be a single output) and fed to means 16, 16'.

It will be clear that many variations are possible within the framework of the invention.

In summary, the invention can be described as follows.

A cathode ray tube comprises means (16, 16') for dynamically influencing the path or shape of the electron beams. The power for the supply current for said means is drawn from the line deflection circuit by means of a transformer (41) arranged in parallel with the line deflection coil (42) or by means of a supply coil (52) wound around the deflection core (51).

What is claimed is:

1. A display device comprising:

a cathode ray tube having an electron gun for generating an electron beam, a phosphor screen on an inner surface of a display window, deflection means including a line deflection coil for deflecting the electron beam, and electromagnetic means for generating a magnetic field to dynamically influence the path or shape of the electron beam as a function of a position where the electron beam hits the phosphor screen, means for supplying line deflection current to said line deflection coil, and means for supplying a current to said electromagnetic means, characterized in that said means for supplying a current receives power solely from said means for supplying line deflection current, and comprises a supply coil coupled to said deflection means and arranged to have a voltage induced therein proportional to a voltage across the line deflection coil.

2. A device as claimed in claim 1, characterized in that said supply coil is a winding on a transformer arranged in parallel with the line deflection coil.

3. A device as claimed in claim 2, characterized in that the cathode ray tube is a color cathode ray tube of the in-line type.

4. A device as claimed in claim 2, characterized in that, in operation, the supply coil draws power from a fly-back voltage.

5. A device as claimed in claim 4, characterized in that said means for supplying a current further comprises a rectifier and a capacitor connected in series with said supply coil, and a current driving circuit receiving power from said capacitor and supplying current to said electromagnetic means, said current driving circuit receiving signals indicating at least one of the vertical and horizontal deflection positions of the electron beam.

6. A device as claimed in claim 1, characterized in that said supply coil is wound around a deflection core of the deflection means.

7. A device as claimed in claim 6, characterized in that the cathode ray tube is a color cathode ray tube of the in-line type.

8. A device as claimed in claim 6, characterized in that, in operation, the supply coil draws power from a fly-back voltage.

9. A device as claimed in claim 8, characterized in that said means for supplying a current further comprises a rectifier and a capacitor connected in series with said supply coil, and a current driving circuit receiving power from said capacitor and supplying current to said electromagnetic means, said current driving circuit receiving signals indicating at least one of the vertical and horizontal deflection positions of the electron beam.

10. A display device comprising:

a cathode ray tube having an electron gun for generating an electron beam, a phosphor screen on an inner surface of a display window, deflection means including a line deflection coil for deflecting the electron beam, and electromagnetic means for generating a magnetic field to dynamically influence the path of the electron beam as a function of a position where the electron beam hits the phosphor screen, means for supplying line deflection current to said line deflection coil, and means for supplying a current to said electromagnetic means, characterized in that said means for supplying a current comprises a supply coil coupled to said deflection means, said supply coil receiving power solely from said means for supplying line deflection current, and said supply coil being arranged to have a voltage induced therein proportional to a voltage across the line deflection coil, and said electromagnetic means generates a magnetic field transverse to said electron beam.

11. A device as claimed in claim 10, characterized in that said electromagnetic means generates a quadrupole magnetic field transverse to said electron beam.

12. A device as claimed in claim 11, characterized in that said supply coil is wound around a deflection core of the deflection means.

13. A device as claimed in claim 11, wherein the cathode ray tube is a color cathode ray tube of the in-line type, characterized in that said means for supplying a current further comprises a rectifier and a capacitor connected in series with said supply coil, and a current driving circuit receiving power from said capacitor and supplying current to said electromagnetic means, said current driving circuit receiving signals indicating at least one of the vertical and horizontal deflection positions of the electron beam.

14. A device as claimed in claim 11, characterized in that said supply coil is a winding on a transformer arranged in parallel with the line deflection coil.

15. A device as claimed in claim 14, wherein the cathode ray tube is a color cathode ray tube of the in-line type.

16. A device as claimed in claims 15, characterized in that said means for supplying a current further comprises a rectifier and a capacitor connected in series with said supply coil, and a current driving circuit receiving power from said capacitor and supplying current to said electromagnetic means, said current driving circuit receiving signals indicating at least one of the vertical and horizontal deflection positions of the electron beam.

17. A device as claimed in claim 14 wherein, in operation, said means for supplying line deflection current produces a flyback voltage, characterized in that the supply coil draws power from the fly-back voltage.

* * * * *